US010283838B2

(12) United States Patent
Wei

(10) Patent No.: US 10,283,838 B2
(45) Date of Patent: May 7, 2019

(54) MULTI-MODE MOBILE DEVICE AND RADIATION ENHANCING DEVICE

(71) Applicant: Wistron NeWeb Corporation, Hsinchu (TW)

(72) Inventor: Shih-Chiang Wei, Hsinchu (TW)

(73) Assignee: WISTRON NEWEB CORPORATION, Hsinchu (TW)

( * ) Notice: Subject to any disclaimer, the term of this patent is extended or adjusted under 35 U.S.C. 154(b) by 0 days.

(21) Appl. No.: 15/674,772

(22) Filed: Aug. 11, 2017

(65) Prior Publication Data

US 2018/0212305 A1 Jul. 26, 2018

Related U.S. Application Data

(60) Provisional application No. 62/450,573, filed on Jan. 26, 2017.

(30) Foreign Application Priority Data

May 11, 2017 (TW) ..... 106115589 A

(51) Int. Cl.

| | |
|---|---|
| ***H01Q 5/385*** | (2015.01) |
| ***H01Q 5/392*** | (2015.01) |
| ***H01Q 1/22*** | (2006.01) |
| ***H01Q 13/10*** | (2006.01) |
| ***H01Q 5/307*** | (2015.01) |

(52) U.S. Cl.
CPC ..... *H01Q 1/2266* (2013.01); *H01Q 1/2291* (2013.01); *H01Q 5/307* (2015.01); *H01Q 5/385* (2015.01); *H01Q 5/392* (2015.01); *H01Q 13/10* (2013.01)

(58) Field of Classification Search
CPC ..... H01Q 1/52; H01Q 1/528; H01Q 1/2266; H01Q 1/2291; H01Q 1/243; H01Q 5/378; H01Q 5/385; H01Q 5/392; H01Q 13/10
See application file for complete search history.

(56) References Cited

U.S. PATENT DOCUMENTS

| | | | | |
|---|---|---|---|---|
| 7,397,439 | B2 * | 7/2008 | Kanno | H01Q 1/24 343/767 |
| 2009/0153412 | A1 * | 6/2009 | Chiang | H01Q 1/52 343/702 |
| 2017/0365930 | A1 * | 12/2017 | Nishioka | G06F 3/04845 |

* cited by examiner

*Primary Examiner* — Robert Karacsony
(74) *Attorney, Agent, or Firm* — McClure, Qualey & Rodack, LLP

(57) ABSTRACT

A multi-mode portable apparatus is provided and includes an upper part, a base, a hinge assembly, and an antenna unit. The upper part includes a cover and a screen frame relative to the cover. The base includes a frame and a bottom cover relative to the frame, in which the bottom cover includes a metal covering part having a first slot and a second slot. The hinge assembly is connected between the upper part and the base thereby allowing the multi-mode portable apparatus to be capable of being flipped to operate in a laptop mode or a tablet mode. The antenna unit is disposed on the upper part, in which the antenna unit operates in at least one operating frequency band.

18 Claims, 8 Drawing Sheets

MULTI-MODE MOBILE DEVICE AND RADIATION ENHANCING DEVICE

CROSS-REFERENCE TO RELATED APPLICATION

This application claims the priority benefit of U.S. provisional application Ser. No. 62/450,573, which was filed on Jan. 26, 2017, and Taiwan application serial no. 106115589, which was filed on May 11, 2017, the contents of which are incorporated hereby by reference

FIELD OF THE INVENTION

The present invention generally relates to a multi-mode portable apparatus, and more particularly to a multi-mode portable apparatus having enhanced antenna radiation efficiency.

BACKGROUND OF THE INVENTION

As mobile communication technology advances, mobile devices have become more and more popular. Portable computers, mobile phones, multimedia players, and other portable electronic devices with multiple functions, have become ubiquitous with their growing popularity. In order to satisfy consumer demands, incorporating wireless communication capabilities in those devices is a must. Some of the wireless communication methods cover longer ranges, such as 2G, 3G, and LTE (Long Term Evolution), which are widely being used in mobile phones that operate in frequency bands of, for instance, 700 MHz, 850 MHz, 900 MHz, 1800 MHz, 1900 MHz, 2100 MHz, 2300 MHz, and 2500 MHz. On the other hand, some of the wireless communication methods cover shorter ranges, like Wi-Fi and Bluetooth systems that usually operate in frequency bands including 2.4 GHz, 5.2 GHz, and 5.8 GHz.

A capable antenna is a critical component to support wireless communications in such mobile devices. However, antenna efficiency is easily affected by the environment such as dense metal components disposed near or around the antenna. Taking an example of conventional multi-mode portable apparatuses, while operating in different modes, the relative position change of the built-in antenna with regard to other metal components easily causes interference with or otherwise impacts the radiation of the antenna and thereby lowers the communication quality. As a result, new solutions for overcoming these drawbacks are strongly desired.

SUMMARY OF THE INVENTION

An aspect of the present invention is to provide a multi-mode portable apparatus that includes an upper part, a base, a hinge assembly, and an antenna unit. The upper part includes a cover and a screen frame relative to the cover. The base includes a frame and a bottom cover relative to the frame, in which the bottom cover includes a metal covering part having a first slot and a second slot. The hinge assembly is connected between the upper part and the base thereby allowing the multi-mode portable apparatus to be capable of being flipped to operate in a laptop mode or a tablet mode. The antenna unit is disposed on the upper part, in which the antenna unit operates in at least one operating frequency band.

Another aspect of the present invention is to provide a radiation enhancing device that includes an antenna unit and a metal covering part. The antenna unit is capable of being operating in an operating frequency band. The metal covering part has a first slot and a second slot, in which the length of the first slot and the length of the second slot substantially equal half of the wavelength of the operating frequency band. The antenna unit is adjacent to the first slot and the second slot. The first slot and the second slot are configured to be emitted by the antenna unit in order to radiate.

Still another aspect of the present invention is to provide a multi-mode portable apparatus that includes an upper part, a hinge assembly, an antenna unit, and a base. The upper part includes a cover and a screen frame relative to the cover. The hinge assembly is connected to the upper part. The antenna unit is located at the vicinity close to an edge of the upper part opposite to the hinge assembly, in which the antenna unit is configured to be operating in at least one operating frequency band. The base is connected to the hinge assembly, and includes a frame and a bottom cover relative to the frame, in which the bottom cover includes a metal covering part having a first slot and a second slot located at the vicinity close to an edge of the base opposite to the hinge assembly, in which the hinge assembly allows the upper part to be manipulated with relation to the base, so as to position the upper part relative to the base to be operated in a laptop mode or a tablet mode. When the multi-mode portable apparatus is positioned to operate in the tablet mode, the first slot and the second slot are substantially adjacent and configured to be coupled with the antenna unit.

BRIEF DESCRIPTION OF THE DRAWINGS

The structure and the technical means adopted by the present invention to achieve the above and other objects can be best understood by referring to the following detailed description of the preferred embodiments and the accompanying drawings.

DETAILED DESCRIPTION OF THE PREFERRED EMBODIMENTS

Figure 1A:
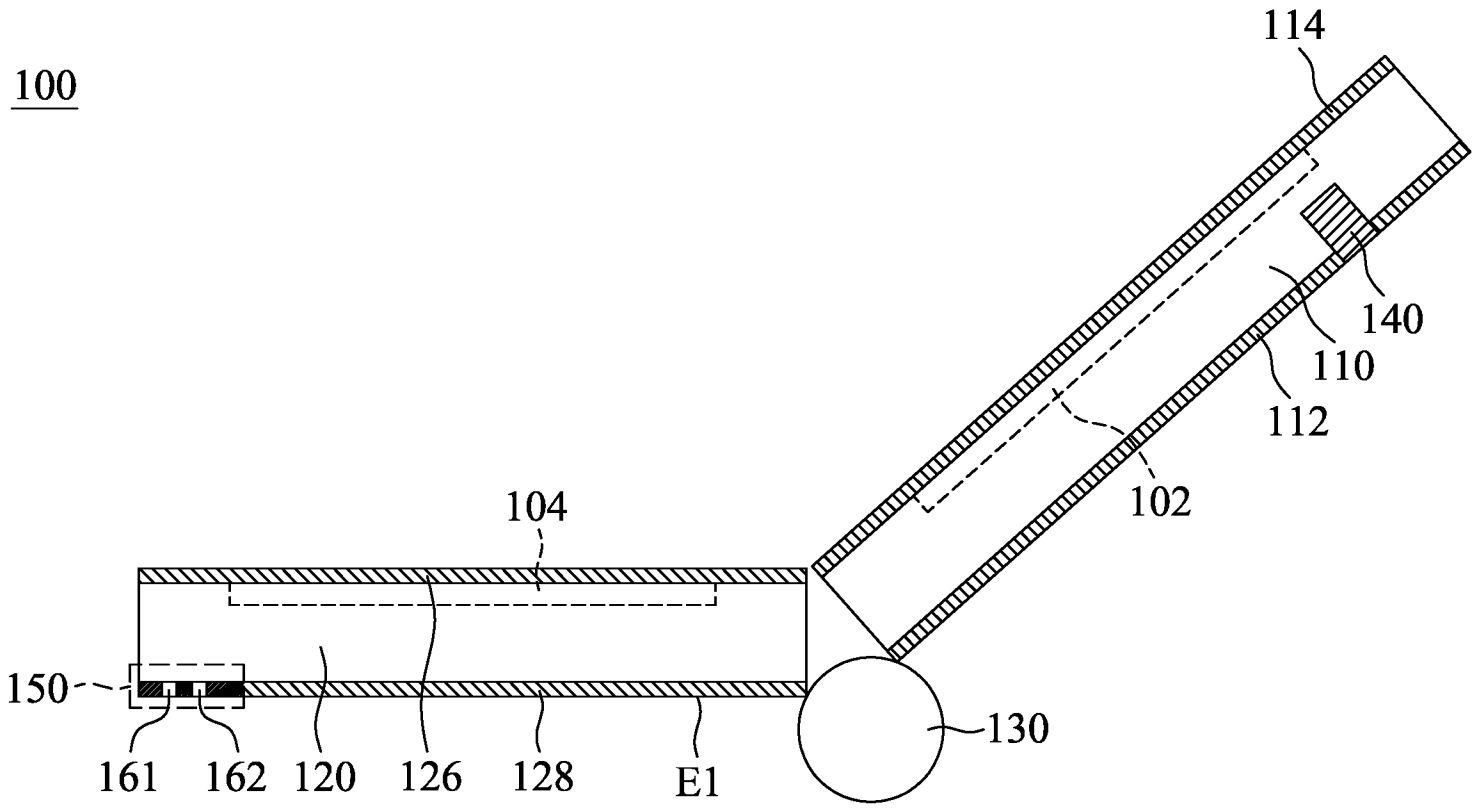
FIG. 1A is a schematic diagram illustrating a multi-mode portable apparatus operating in a laptop mode according to an embodiment of the present invention.

Reference will now be made in detail to the present preferred embodiments of the invention, examples of which are illustrated in the accompanying drawings. Wherever possible, the same reference numbers are used in the drawings and the description to refer to the same or like parts. It is not intended to limit the method or the system by the exemplary embodiments described herein. In the following detailed description, for purposes of explanation, numerous specific details are set forth in order to attain a thorough understanding of the disclosed embodiments. It will be apparent, however, that one or more embodiments may be practiced without these specific details. As used in the description herein and throughout the claims that follow, the meaning of "a", "an", and "the" includes reference to the plural unless the context clearly dictates otherwise. Also, as used in the description herein and throughout the claims that follow, the terms "comprise or comprising", "include or including", "have or having", "contain or containing" and the like are to be understood to be open-ended, i.e., to mean including but not limited to. As used in the description herein and throughout the claims that follow, the meaning of "in" includes "in" and "on" unless the context clearly dictates otherwise.

It will be understood that when an element is referred to as being "connected" to another element, it can be directly connected to the other element or intervening elements may be present, unless otherwise specified.

Figure 1B:
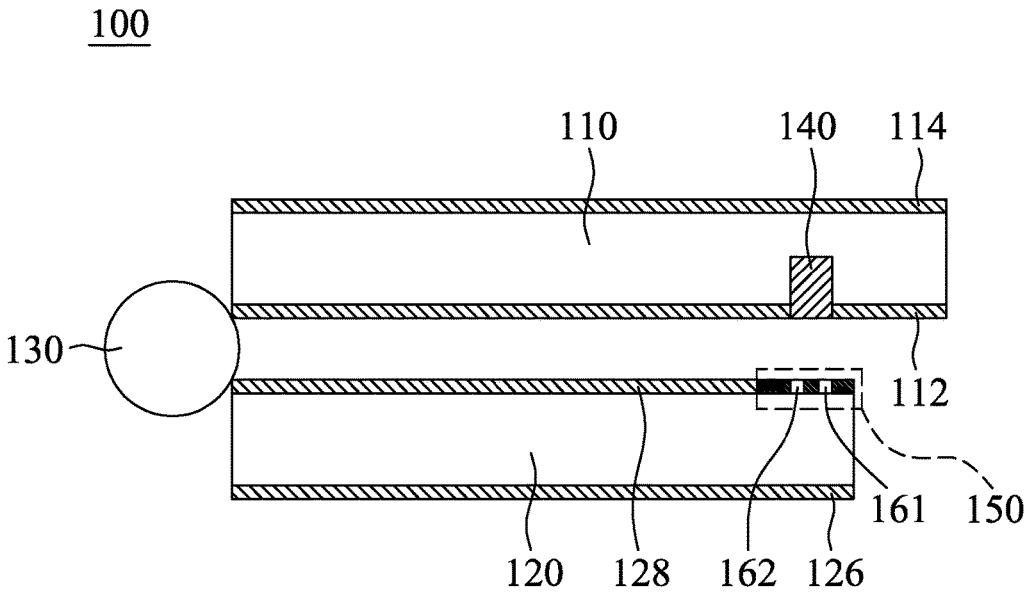
FIG. 1B is a schematic diagram illustrating the multi-mode portable apparatus operating in a tablet mode according to an embodiment of the present invention.

FIG. 1A is a schematic diagram illustrating a multi-mode portable apparatus operating in a laptop mode according to an embodiment of the present invention, and FIG. 1B is a schematic diagram illustrating the multi-mode portable apparatus operating in a tablet mode according to an embodiment of the present invention. The tablet mode generally means that a multi-mode laptop computer, operating in normal laptop mode, was manipulated so that the bottom and the back cover of the screen of that laptop are positioned adjacent to each other (e.g., back-to-back). The multi-mode portable apparatus 100 at least includes an upper part 110, a base 12, a hinge assembly 130, and an antenna unit 140. Except for the features of the multi-mode portable apparatus shown in FIG. 1A and FIG. 1B, additional elements such as touch panel, processor, battery module, and input/output device may also be included.

The upper part 110 includes a cover 112 and a screen frame 114 relative to the cover 112, in which the term "relative to" generally means that the orthogonal projection planes of the cover 112 and the screen frame 114 mostly overlap to each other. A display device 102 can be embedded into the screen frame 114. The base 120 includes a frame 126 and a bottom cover 128 relative to the frame 126. In some embodiments, the frame 126 can be a keyboard frame allowing a keyboard 104 to be embedded into the frame 126. The hinge assembly 130 is connected between the upper part 110 and the base 120. While manipulating the multi-mode portable apparatus 100 by pivoting the hinge assembly 130, the multi-mode portable apparatus 100 can be selectively operating in one of the laptop mode or the tablet mode. In particular, while the multi-mode portable apparatus 100 is operating in the laptop mode, the included angle between the cover 112 and the bottom cover 128 is greater than 180°.

The antenna unit 140 is disposed on the cover 112 of the upper part 110. According to an embodiment of the present invention, the antenna unit 140 is disposed at the vicinity close to an edge of the upper part 110, which is located oppositely from the hinge assembly 130. More specifically, while the upper part 110 is equally divided into three sections from the hinge assembly 130 to the edge of the upper part 110, the vicinity close to the edge of the upper part 110 means the section closest to the edge of the upper part 110. Nonetheless, the location where the antenna unit 140 is disposed is not limited to those mentioned above. In some embodiments, the antenna unit 140 may also be disposed close to the hinge assemble 130. The antenna unit 140 can be operated in at least one operating frequency band. In some embodiments, the cover 112 can be a metal cover, and the antenna unit 140 can be a slot antenna forming on the metal cover. In some other embodiments, the cover 112 can be a plastic cover, and the antenna unit 140 can be a monopole antenna, a dipole antenna, a loop antenna, a patch antenna, a planar inverted F antenna (PIFA), or a chip antenna, disposed in the upper part 110 or behind the plastic cover; the cover 112 can be made of other non-metal materials as well, as long as the radiation of the antenna unit 140 can be radiated out of the cover 112. In addition to the conventional multi-mode portable apparatuses as previously mentioned, namely the so-called yoga laptops, their antenna units always radiates better while operating in laptop mode because they are not being shielded or interfered by other metal or electrical components. However, while those operate in tablet mode, the antenna unit will be positioned very close to the bottom cover, the metal portion of the bottom cover and/or the electrical components located inside the base will interfere and shield the radiation of the antenna unit thereby consequently reducing radiation. In order to improve the radiation efficiency of the antenna units when operating in tablet mode, a novel solution of the present invention is described below.

Figure 6:
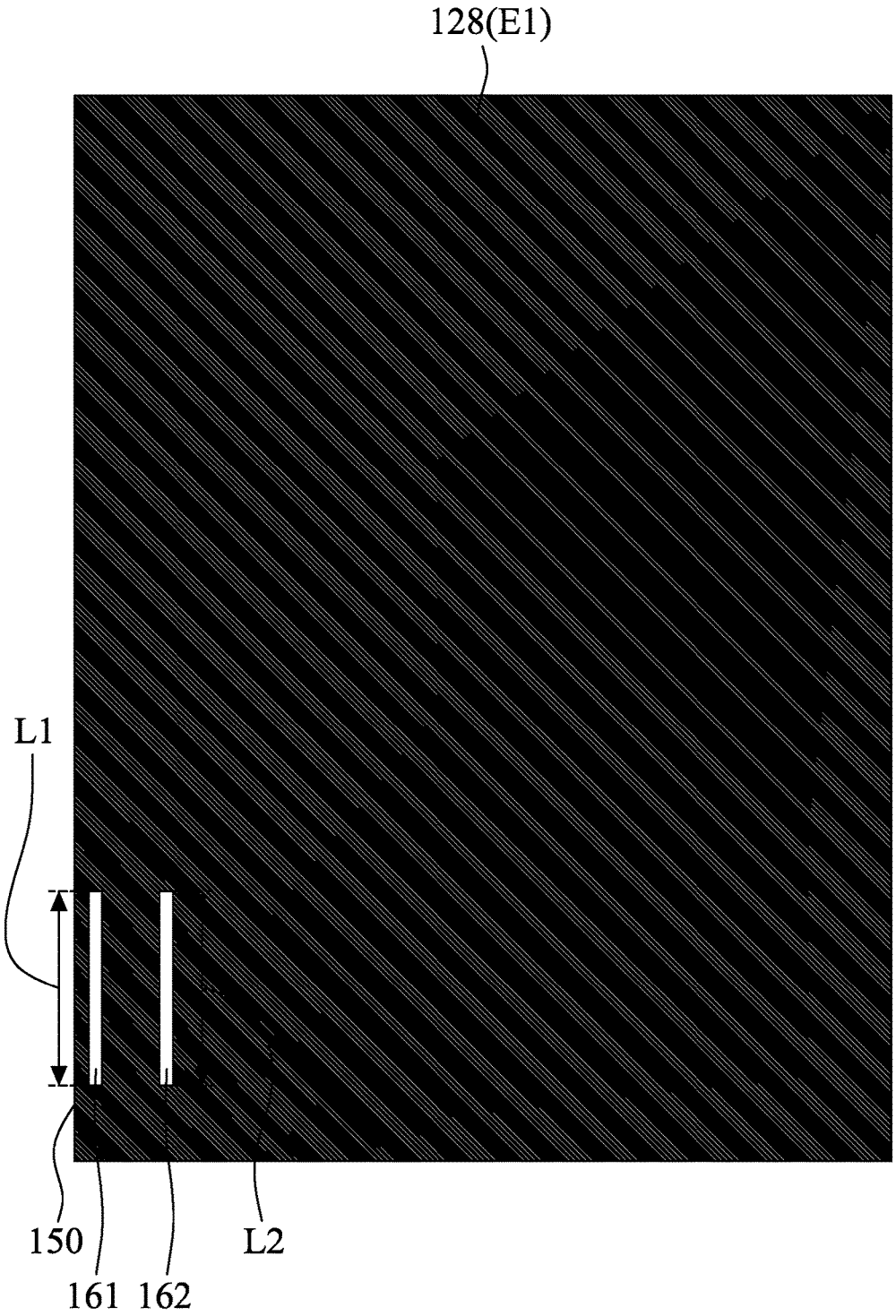
FIG. 6 is a schematic diagram showing the metal covering part covering the outer surface of the bottom cover entirely.

In a preferred embodiment, the bottom cover 128 includes a metal covering part 150. The metal covering part 150 includes a first slot 161 and a second slot 162. The first slot 161 and the second slot 162 are located at the vicinity close to an edge of the base 120 opposite to the hinge assembly 130. More specifically, while the base 120 is equally divided into three sections from the hinge assembly 130 to the edge of the base 120, the vicinity close to the edge of the base 120 is the section closest to the edge of the base 120. The metal covering part 150 can be, for instance, a metal foil or a metal film formed by using electrical plating. The hinge assembly 130 may include a conductive element in order to electrically couple the metal covering part 150 of the bottom cover 128 to the cover 112, i.e. the metal cover as described above. In some embodiments, the metal covering part 150 at least partially covers an outer surface E1 of the bottom cover 128 (see FIG. 2 as an instance). Alternatively, in other embodiments, the metal covering part 150 covers the outer surface E1 of the bottom cover 128 entirely (see FIG. 6).

Figure 2:
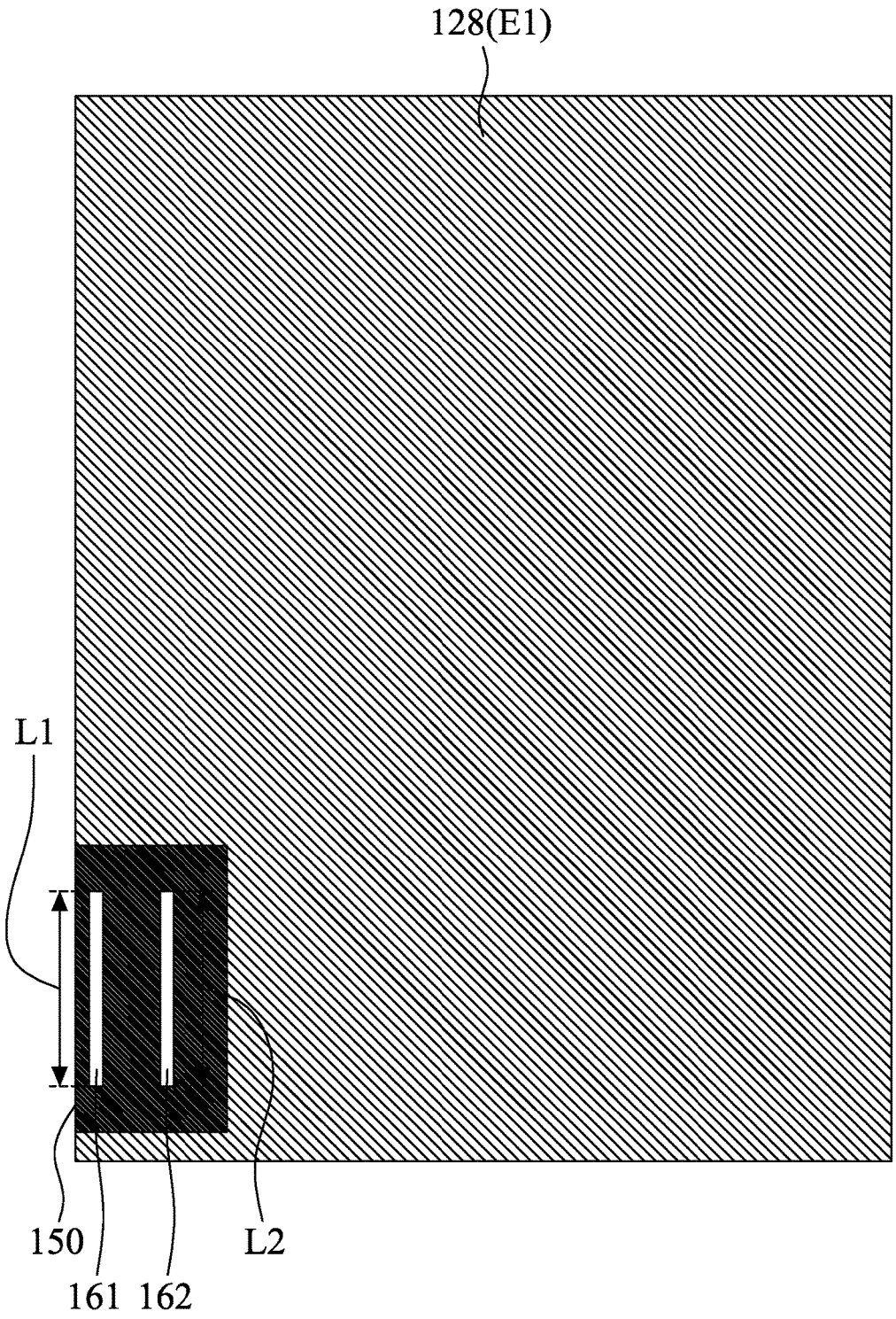
FIG. 2 is a schematic diagram illustrating the bottom cover and the metal covering part of the multi-mode portable apparatus illustrated in FIG. 1A and FIG. 1B according to an embodiment of the present invention.

FIG. 2 is a schematic diagram illustrating the bottom cover 128 and the metal covering part 150 of the multi-mode portable apparatus 100 illustrated in FIG. 1A and FIG. 1B, according to an embodiment of the present invention. In this embodiment, each of the first slot 161 and the second slot 162 is formed in a linear shape, where the first slot 161 and the second slot 162 are arranged in parallel. The length L1 of the first slot 161 and the length L2 of the second slot 162 are approximately half of the wavelength ($\lambda/2$) of the antenna unit 140 operating frequency band. For instance, the aforementioned operating frequency band can be between 2400 MHz and 2500 MHz, and/or 5150 MHz and 5850 MHz. In some embodiments, the length L1 of the first slot 161 can be slightly greater than the length L2 of the second slot 162. For instance, the length L1 of the first slot can be around the half wavelength of 2400 MHz, and the length L2 of the second slot 162 can be around the half wavelength of 2500 MHz. In some other embodiments, oppositely, the length L1 of the first slot 161 can be slightly smaller than the length L2 of the second slot 162; the length L1 of the first slot can be around the half wavelength of 2500 MHz, and the length L2 of the second slot 162 can be around the half wavelength of 2400 MHz. In addition, the first slot 161 and the second slot 162 can be formed in different shapes (figure not shown) as well, where the first slot 161 and the second slot 162 are sized to operate either in between 2400 MHz and 2500 MHz, or 5150 MHz and 5850 MHz, and the lengths of the first slot 161 and the second slot 162 are about half of the wavelength of the antenna unit 140 operating frequency band.

Now reference is made to FIG. 1B and FIG. 2. While the multi-mode portable apparatus 100 is being operated in the tablet mode, the antenna unit 140 will be physically adjacent to the first slot 161 and the second slot 162, and the screen frame 114, the cover 112, the bottom cover 128, and the frame 126 are arranged sequentially. As a result, the metal covering part 150, the first slot 161 and the second slot 162, can be emitted by the antenna unit 140 to generate radiation. Note that the term "adjacent" mentioned above means that the shortest distance between the antenna unit 140 and the first slot 161 or the second slot 162 ranges from 0 mm to 5 mm. Under this design, the metal covering part 150 can be worked as an extension part of the antenna unit 140 due to the coupling effect between the adjacent elements as set forth above. Therefore, not only can the metal covering part 150 reduce the interference to the radiation pattern of the antenna unit 140, but it can also enhance the radiation efficiency of the antenna unit 140 by resonating with it.

In some embodiments, the antenna unit 140 and the metal covering part 150 can be used as an independent radiation enhancing device, which does not necessarily need to be operated with the other components included in the multi-mode portable apparatus 100. The structural feature of the radiation enhancing device is same as the previously mentioned embodiments of FIG. 1A, FIG. 1B, and FIG. 2 and will not be repeated here.

Figure 3:
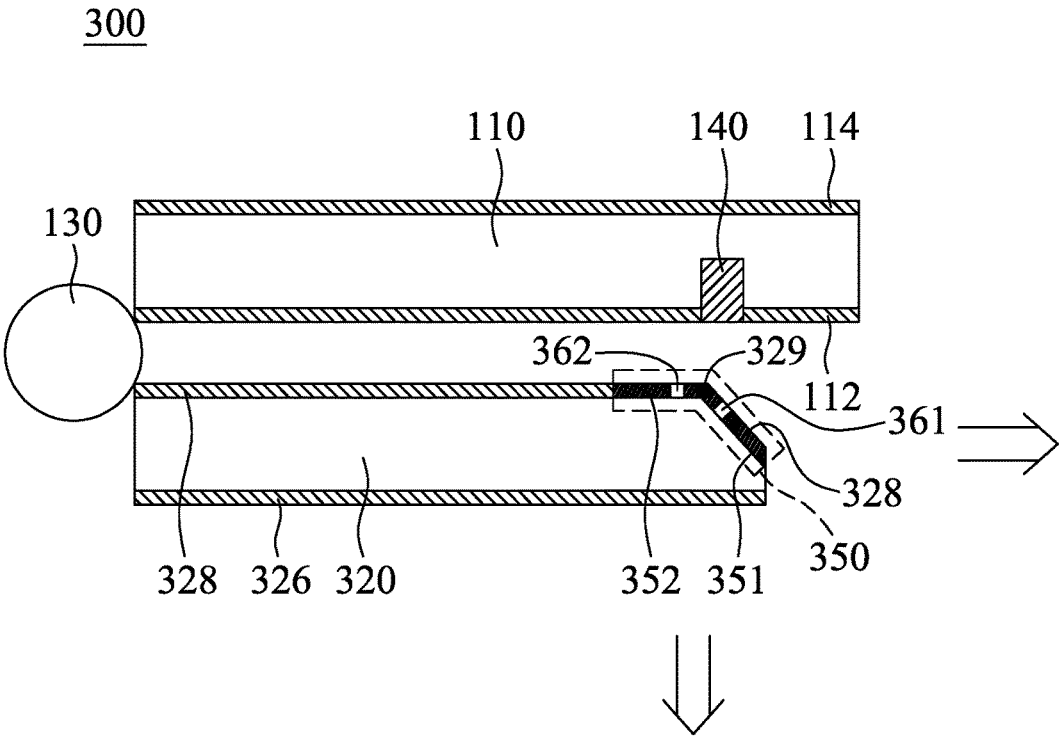
FIG. 3 is a schematic diagram of a multi-mode portable apparatus operating in the tablet mode according to an embodiment of the present invention.

FIG. 3 is a schematic diagram of a multi-mode portable apparatus 300 operating in the tablet mode according to an embodiment of the present invention, and is similar to FIG. 1B. In this embodiment, a bottom cover 328 of a base 320 of the multi-mode portable apparatus 300 has an angled edge 329, and thereby forming a bevel on the base 320 so that electrical components such as speakers can be disposed on there. A metal covering part 350 of the bottom cover 328 is attached to the angled edge 329, so as to form a bending shape on the metal covering part 350 as well. More specifically, the metal covering part 350 includes a first metal surface 351 and a second metal surface 352 that are connected to each other. The angled edge 329 of the bottom cover 328 is located between the first metal surface 351 and the second metal surface 352; as a result, the extended planes of the first metal surface 351 and the second metal surface 352 are different. For instance, the first metal surface 351 and the second metal surface 352 may intersect at the angled edge 329 and the included angle between the first metal surface 351 and the second metal surface 352 can range between 0° to 80°, and more preferably, 45°.

In some alternative embodiments, the extended surfaces of the first metal surface 351 and the second metal surface 352 can be located on different planes that are parallel to each other, thereby forming a stair-like structure (Fig. not shown). In the embodiment illustrated in FIG. 3, the first slot 361 is formed on the first metal surface 351, and the second slot 362 is formed on the second metal surface 352. Under this arrangement, while the multi-mode portable apparatus 300 is being operated in the tablet mode, the angled edge 329 of the bottom cover 328 will be adjacent to the antenna unit 140, and the metal covering part 350, the first slot 361 and the second slot 362 will be emitted by the antenna unit 140 thereby generating radiation. Because the first slot 361 and the second slot 362 are located on different planes, namely the first metal surface 351 and the second metal surface 352, the radiation strength of the antenna unit 140 can be enhanced in a broader range (see the arrows pointing downward and rightward in FIG. 3, indicating the radiation directions). Hence, by adding the bending structure, the angled edge 329, to the bottom cover 328, the radiation pattern of the antenna unit 140 may be more omnidirectional.

Figure 4:
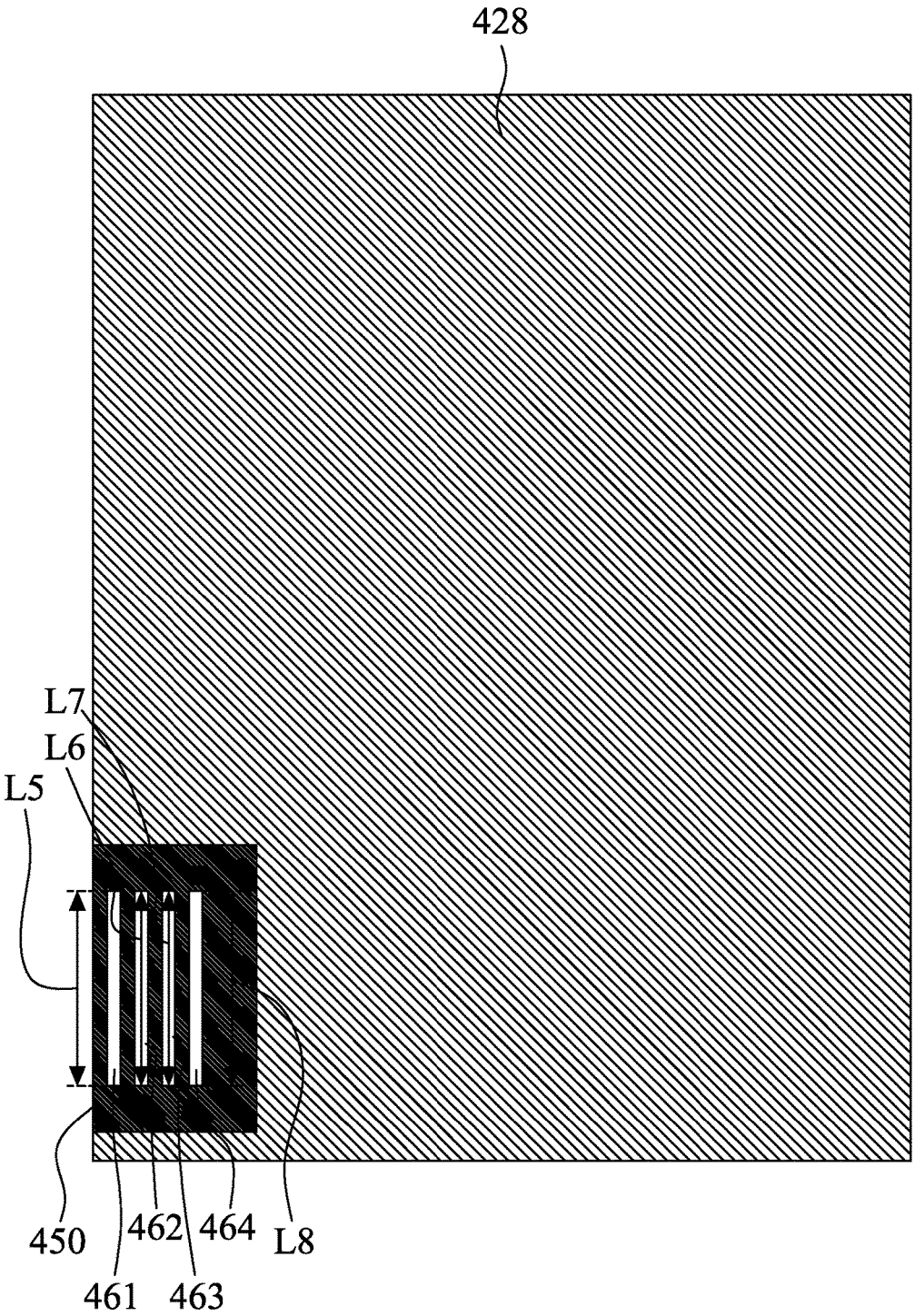
FIG. 4 is a schematic diagram illustrating a bottom cover and a metal covering part according to an embodiment of the present invention.
Figure 7:
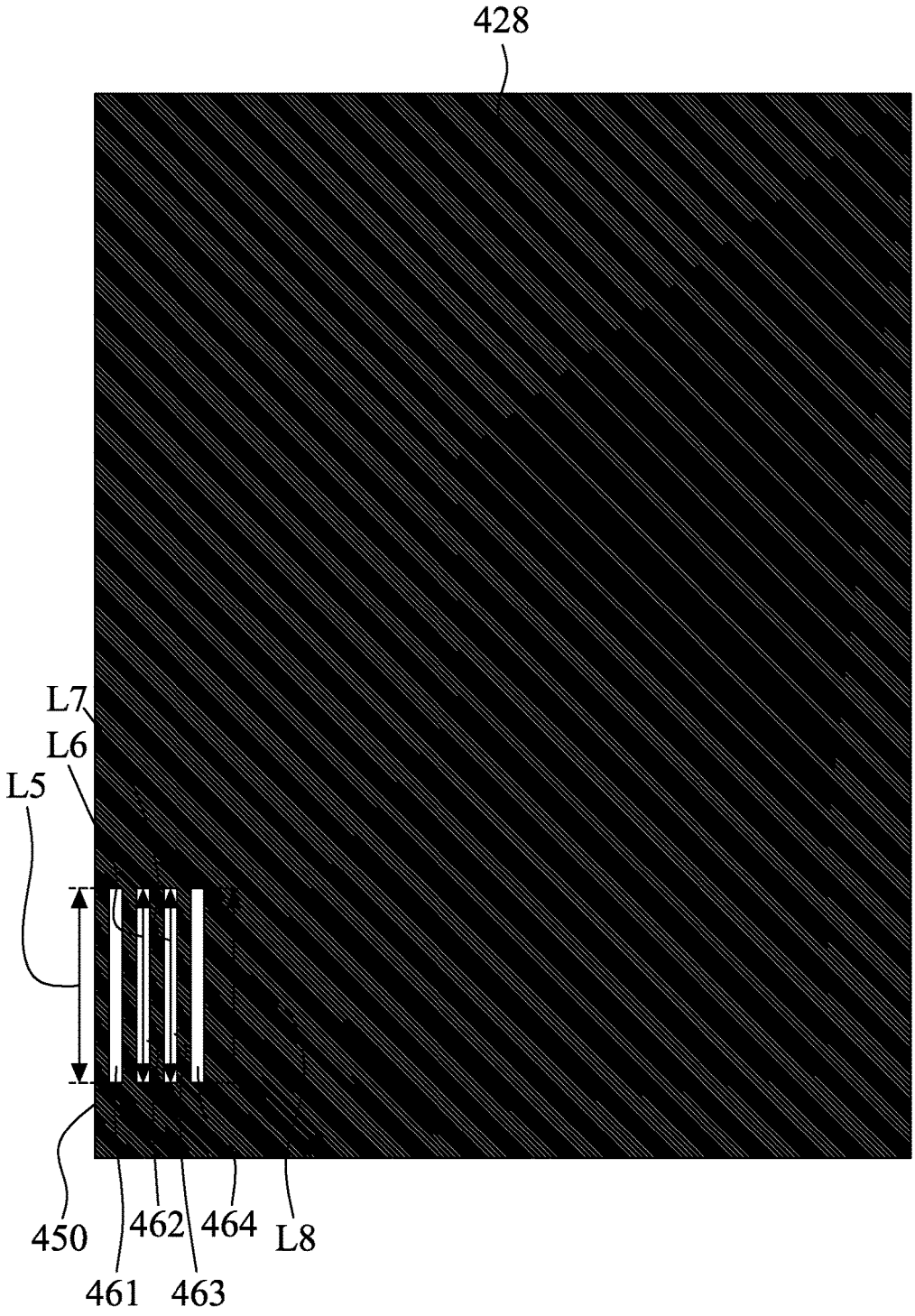
FIG. 7 is a schematic diagram of another embodiment showing the metal covering the bottom cover entirely.

FIG. 4 is a schematic diagram illustrating a bottom cover 428 and a metal covering part 450 according to an embodiment of the present invention. The bottom cover 428 and the metal covering part 450 of this embodiment are applicable to all of the aforementioned embodiments illustrated in either FIG. 1 or FIG. 3. In this embodiment, the metal covering part 450 has a first slot 461, a second slot 462, a third slot 463, and a fourth slot 464 formed on, in which each of the first slot 461, the second slot 462, the third slot 463, and the fourth slot 464 is in a linear shape, a straight line shape, and is in parallel to one another. The length L5 of the first slot 461, the length L6 of the second slot 462, the length L7 of the third slot 463, and the length L8 of the fourth slot 474 are all approximately half of the wavelength of the operating frequency band (212). In some embodiments, the length L5 of the first slot 461 can be slightly greater than the length L6 of the second slot 462, and the length L7 of the third slot 463 can be slightly greater than the length L8 of the fourth slot 464. In some other embodiments, oppositely, the length L5 of the first slot 461 can be slightly smaller than the length L6 of the second slot 462, and the length L7 of the third slot 463 can be slightly smaller than the length L8 of the fourth slot 464. In some embodiments, the metal covering part 450 at least partially covers the bottom cover 428 (see FIG. 4). Alternatively, in other embodiments, the metal covering part 450 covers the bottom cover 428 entirely (see FIG. 7). This kind of multiple slot design can broaden the bandwidth of the metal covering part 450.

As mentioned, the embodiment illustrated in FIG. 4 can be applicable to embodiments of FIG. 1 or FIG. 3; while applying to FIG. 3, the first slot 361 can be replaced by the first slot 461 and the second slot 462, and the second slot 362 can be replaced by the third slot 463 and the fourth slot 464, where the first slot 461 and the second slot 462 are located at the first metal surface 351, and the third slot 463 and the fourth slot 464 are located at the second metal surface 352. Alternatively, the first slot 461, the second slot 462, the third slot 463, and the fourth slot 464 of the embodiment of FIG. 4 can also be added to the structure depicted in FIG. 3, that is, the first slot 361, the first slot 461, and the second slot 462 being located at the first metal surface 351, and the second slot 362, the third slot 463 and the fourth slot 464 being located at the second metal surface 352. Similarly, while applying the embodiment of FIG. 4 to FIG. 1, the first slot 161 and the second slot 162 can either be replaced with the first slot 461, the second slot 462, the third slot 463, and the fourth slot 464 (4 slots total), or be additional to the first slot 161 and the second slot 162 (6 slots total). Other structural features of the bottom cover 428 and the metal covering part 450 in FIG. 4 are similar to their corresponding parts in FIG. 1, and will not be repeated herein.

Figure 5:
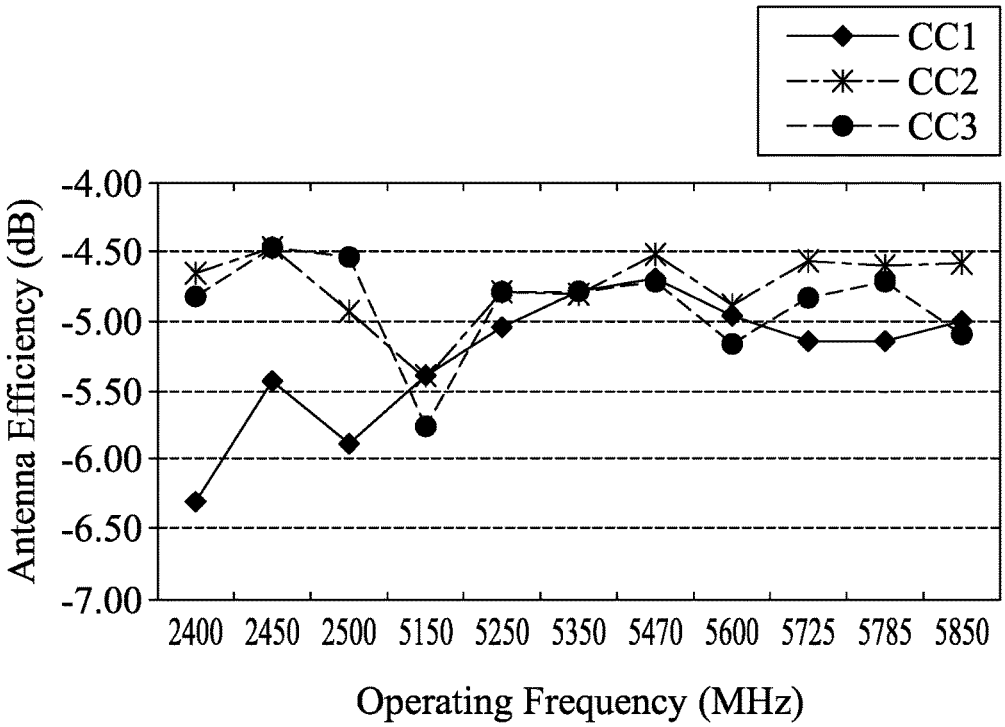
FIG. 5 is a plot diagram of the antenna efficiency of the antenna unit of the multi-mode portable apparatus according to an embodiment of the present invention.

FIG. 5 is a plot diagram of the antenna efficiency of the antenna unit 140 of the multi-mode portable apparatus 100/300 according to an embodiment of the present invention, in which the horizontal axis represents the operating frequency (MHz), and the vertical axis represents the antenna efficiency (dB), where CC1 represents the radiation characteristics of the antenna unit 140 without operating with any metal covering part or slots, CC2 represents the radiation characteristics of the antenna unit 140 being operated with the metal covering part 150 that includes the two slots 361 and 362 (see FIG. 2), and CC3 represents the radiation characteristics of the antenna unit 140 being operated with the metal covering part 150 that includes the four slots 461, 462, 463, and 464 (see FIG. 4). As shown in FIG. 5, the antenna efficiency of the antenna unit 140 operating without the metal covering part and the slots at the center of low frequency 2450 MHz is about −5.42 dB (CC1). After implementing the proposed improvements of the present invention, the antenna efficiency of the antenna unit 140 operating with the metal covering part 150 that has two slots 361 and 362 has been significantly increased to about −4.5 dB (CC2), and the antenna efficiency of the antenna unit 140 operating with the metal covering part 150 that has four slots 461, 462, 463, and 464 has been significantly increased to about −4.48 dB (CC3), which are capable of being fully applied to modern portable communication systems.

The multi-mode portable apparatus and the radiation enhancing device provided in the present invention can effectively overcome the drawbacks in conventional yoga (multi-mode) laptop computers such as significant reduction of the radiation efficiency of the antenna unit while operating in the tablet mode. Therefore, the present invention is suitable for use in various types of multi-mode mobile communication devices to improve their communication quality.

The description of the invention including its applications and advantages as set forth herein is illustrative and is not intended to limit the scope of the invention, which is set forth in the claims. Variations and modifications of the embodiments disclosed herein are possible, and practical alternatives to and equivalents of the various elements of the embodiments would be understood to those of ordinary skill in the art upon study of this patent document. For example, specific values given herein are illustrative unless identified as being otherwise, and may be varied as a matter of design consideration. Terms such as "target" and "background" or so are distinguishing terms and are not to be construed to imply an order or a specific part of the whole. These and other variations and modifications of the embodiments disclosed herein, including of the alternatives and equivalents of the various elements of the embodiments, may be made without departing from the scope and spirit of the invention, including the invention as set forth in the following claims.

What is claimed is:

1. A multi-mode portable apparatus, comprising:

an upper part, including a cover and a screen frame relative to the cover;

a base, including a frame and a bottom cover relative to the frame, wherein the bottom cover includes a metal covering part having a first slot and a second slot;

a hinge assembly, connected between the upper part and the base thereby allowing the upper part to be manipulated with relation to the base, so as to position the upper part relative to the base to be operated in a laptop mode or a tablet mode;

an antenna unit, disposed on the upper part, wherein the antenna unit operates in at least one operating frequency band;

wherein, when the multi-mode portable apparatus is positioned to operate in the tablet mode, the first slot and the second slot are substantially adjacent and configured to be coupled with the antenna unit;

wherein the bottom cover has an angled edge; and wherein the metal covering part comprises a first metal surface and a second metal surface, the angled edge is located between the first metal surface and the second metal surface, and the first metal surface and the second metal surface are located on different planes.

2. The multi-mode portable apparatus as claimed in claim 1, wherein the antenna unit is a slot antenna disposed on the cover of the upper part, and the frame of the base includes a keyboard embedded therein.

3. The multi-mode portable apparatus as claimed in claim 1, wherein the length of the first slot and the length of the second slot substantially equal half of the wavelength of the operating frequency band.

4. The multi-mode portable apparatus as claimed in claim 1, wherein the length of the first slot is longer than the length of the second slot.

5. The multi-mode portable apparatus as claimed in claim 1, wherein the first slot and the second slot are substantially in linear shapes.

6. The multi-mode portable apparatus as claimed in claim 5, wherein the first slot and the second slot are disposed substantially in parallel.

7. The multi-mode portable apparatus as claimed in claim 1, wherein the first slot and the second slot are sized to operate in between 2400 MHz and 2500 MHz, and 5150 MHz and 5850 MHz, respectively.

8. The multi-mode portable apparatus as claimed in claim 1, wherein when the multi-mode portable apparatus operates in the tablet mode, the screen frame, the cover, the bottom cover, and the frame are arranged sequentially, and the antenna unit is adjacent to the first slot and the second slot, so that the first slot and the second slot are emitted by the antenna unit to radiate.

9. The multi-mode portable apparatus as claimed in claim 1, wherein the metal covering part at least partially covers the outer surface.

10. The multi-mode portable apparatus as claimed in claim 1, wherein the first slot is located on the first metal surface, and the second slot is located on the second metal surface.

11. The multi-mode portable apparatus as claimed in claim 1, wherein when the multi-mode portable apparatus is operating in the tablet mode, the angled edge of the bottom cover is adjacent to the antenna unit.

12. The multi-mode portable apparatus as claimed in claim 1, wherein the metal covering part further comprises a third slot and a fourth slot respectively located on the first metal surface and the second metal surface.

13. The multi-mode portable apparatus as claimed in claim 12, wherein the length of the third slot and the length of the fourth slot substantially equal half of the wavelength of the operating frequency band.

14. The multi-mode portable apparatus as claimed in claim 12, wherein the length of the third slot is longer than the length of the fourth slot.

15. The multi-mode portable apparatus as claimed in claim 12, wherein the third slot and the fourth slot are substantially in linear shapes, and the first slot, the second slot, the third slot and the fourth slot are substantially in parallel.

16. A radiation enhancing device, comprising:

an antenna unit, capable of being operating in an operating frequency band; and a metal covering part, having a first slot and a second slot, wherein the length of the first slot and the length of the second slot substantially equal half of the wavelength of the operating frequency band, the antenna unit is adjacent to the first slot and the second slot, and the first slot and the second slot are configured to be emitted by the antenna unit in order to radiate, wherein the first slot and the second slot are located at different planes and substantially in linear shapes and parallel to each other;

wherein the metal covering part is at least a part of a bottom cover having an angled edge; and wherein the metal covering part comprises a first metal surface having the first slot located therein and a second metal surface having the second slot located therein, wherein the angled edge is located between the first metal surface and the second metal surface, and the first metal surface and the second metal surface are located on different planes.

17. A multi-mode portable apparatus, comprising:

an upper part, including a cover and a screen frame relative to the cover;

a hinge assembly, connected to the upper part;

an antenna unit, located at the vicinity close to an edge of the upper part opposite to the hinge assembly, wherein the antenna unit is configured to be operating in at least one operating frequency band;

a base connected to the hinge assembly, and including a frame and a bottom cover relative to the frame, wherein the bottom cover includes a metal covering part having a first slot and a second slot located at the vicinity close to an edge of the base opposite to the hinge assembly, wherein the hinge assembly allows the upper part to be manipulated with relation to the base, so as to position the upper part relative to the base to be operated in a laptop mode or a tablet mode;

wherein, when the multi-mode portable apparatus is positioned to operate in the tablet mode, the first slot and the second slot are substantially adjacent and configured to be coupled with the antenna unit;

wherein the bottom cover has an angled edge; and wherein the metal covering part comprises a first metal surface and a second metal surface, wherein the angled edge is located between the first metal surface and the second metal surface, and the first metal surface and the second metal surface are located on different planes.

18. The multi-mode portable apparatus as claimed in claim 17, wherein the distance between the antenna unit and the first slot or the second slot ranges from 0 mm to 5 mm.

* * * * *